US009119231B2

(12) United States Patent
Johnson et al.

(10) Patent No.: US 9,119,231 B2
(45) Date of Patent: Aug. 25, 2015

(54) METHOD FOR PREHEATING AN OVEN APPLIANCE

(71) Applicant: General Electric Company, Schenectady, NY (US)

(72) Inventors: Eric Scott Johnson, Louisville, KY (US); Matthew David Gladhill, Louisville, KY (US)

(73) Assignee: General Electric Company, Schenectady, NY (US)

( * ) Notice: Subject to any disclaimer, the term of this patent is extended or adjusted under 35 U.S.C. 154(b) by 420 days.

(21) Appl. No.: 13/690,232

(22) Filed: Nov. 30, 2012

(65) Prior Publication Data

US 2014/0151362 A1 Jun. 5, 2014

(51) Int. Cl.
*H05B 1/02* (2006.01)

(52) U.S. Cl.
CPC ..... *H05B 1/0263* (2013.01)

(58) Field of Classification Search
CPC .. H05B 1/0263; H05B 1/0266; H05B 1/0261; H05B 3/0076; H05B 6/12
USPC ..... 219/497, 494, 492, 412–414, 483–485
See application file for complete search history.

(56) References Cited

U.S. PATENT DOCUMENTS

| | | | | |
|---|---|---|---|---|
| 6,388,235 | B1 * | 5/2002 | Sauter et al. | 219/400 |
| 6,809,301 | B1 | 10/2004 | McIntyre et al. | |
| 6,943,321 | B2 | 9/2005 | Carbone et al. | |
| 8,049,142 | B2 | 11/2011 | Blackson et al. | |
| 8,304,695 | B2 * | 11/2012 | Bonuso et al. | 219/400 |
| 2002/0066724 | A1 * | 6/2002 | Brown et al. | 219/400 |
| 2004/0200825 | A1 * | 10/2004 | Ahuja | 219/446.1 |
| 2006/0289436 | A1 * | 12/2006 | Carbone et al. | 219/400 |
| 2009/0255920 | A1 | 10/2009 | Bonassi et al. | |
| 2013/0146581 | A1 * | 6/2013 | Donarski et al. | 219/413 |

* cited by examiner

*Primary Examiner* — Mark Paschall
(74) *Attorney, Agent, or Firm* — Dority & Manning, P.A.

(57) ABSTRACT

An oven appliance and a method for preheating the same are provided. The oven appliance includes a broil heating element, a bake heating element, and a convection heating assembly with a convection heating element or a fan or both. The method includes initiating a preheat cycle having a first phase and a second phase. During the second phase of the preheat cycle, a power output of the convection heating element is reduced or an angular velocity of the fan is decreased or both.

19 Claims, 6 Drawing Sheets

METHOD FOR PREHEATING AN OVEN APPLIANCE

FIELD OF THE INVENTION

The present subject matter relates generally to oven appliances and methods for preheating the same.

BACKGROUND OF THE INVENTION

Convection oven appliances generally include a cabinet that defines a cooking chamber for receipt of food items for cooking. Heating elements are positioned within the cooking chamber to provide heat to food items located therein. The heating elements can include a bake heating element positioned at a bottom of the cooking chamber and/or a broil heating element positioned at a top of the cooking chamber. Convection oven appliances also include a fan or other mechanism for creating a flow of air within the cooking chamber. Convection oven appliances can also include a convection heating element for heating the flow of air within the cooking chamber.

During operation of convection oven appliances, food items with the appliances' cooking chamber are heated through various heat transfer mechanisms. Such mechanisms include: (1) radiation from oven walls, an oven door, and/or any exposed heating elements in the cooking chamber; (2) various convection mechanisms; and (3) conduction from a surface supporting the food items, e.g., a rack. Radiant heat transfer can provide a significant portion of the heat transferred to food items within the cooking chamber when the oven appliance is at a steady-state operating temperature.

Generally, oven appliances are preheated prior to inserting food items into the appliance's cooking chamber. Such preheating can be necessary to heat the oven appliance's walls, doors, and other exposed surfaces and bring the oven appliance up to the steady-state operating temperature. Prior to such preheating, radiant heat transfer from such components can be insufficient or unsuitable to properly cook food items within the cooking chamber. Generally, oven appliances activate the broil heating element and the bake heating element during the preheat cycle. In particular, the broil heating element and the bake heating element are generally operated a single constant power output during the preheat cycle until the steady-state operating temperature is obtained. During such preheating cycles, food items placed in the cooking chamber may not cook properly because the amount of heat provided to the food items and balance of such heat does not match that of a preheated (steady-state) oven. In particular, the top portion of the food items may cook more quickly than the bottom portion of the food items due to the activated broil heating element.

To avoid such heat imbalance, a user generally waits for the cooking chamber to reach the steady-state cooking temperature before inserting food items into the cooking chamber. However, waiting for the oven to preheat can consume a significant amount of the user's time. For example, preheat cycles can take over ten minutes to complete. In addition, valuable energy is consumed during preheating cycles that could be used to cook food items. Accordingly, an oven appliance with features for facilitating satisfactory cooking of food items during a preheat cycle of the oven appliance would be useful. In particular, an oven appliance with features for maintaining a substantially constant output of total power for cooking of food items within the cooking chamber during the preheat cycle would be useful.

BRIEF DESCRIPTION OF THE INVENTION

The present subject matter provides an oven appliance and a method for preheating the same. The oven appliance includes a broil heating element, a bake heating element, and a convection heating assembly with a convection heating element or a fan or both. The method includes initiating a preheat cycle having a first phase and a second phase. During the second phase of the preheat cycle, a power output of the convection heating element is reduced or an angular velocity of the fan is decreased or both. Additional aspects and advantages of the invention will be set forth in part in the following description, or may be apparent from the description, or may be learned through practice of the invention.

In a first exemplary embodiment, a method for preheating an oven appliance is provided. The oven appliance includes a cabinet that defines a cooking chamber for receipt of food items for cooking. The cooking chamber extends between a top portion and bottom portion. The oven appliance also includes a bake heating element positioned adjacent the bottom portion of the cooking chamber and a broil heating element positioned adjacent the top portion of the cooking chamber. The oven appliance further includes a convection heating assembly having a fan and a convection heating element. The convection heating assembly is configured for selectively urging a flow of heated air into the cooking chamber. The method comprises the steps of: initiating a preheat cycle of the oven appliance, the cooking chamber changing from a first temperature to a second temperature during the preheat cycle, the second temperature being greater than the first temperature, the preheat cycle having a first phase and a second phase; operating at least one of the convection heating element, the broil heating element, and the bake heating element for the first phase of the preheat cycle of the oven appliance; utilizing the convection heating element during the second phase of the preheat cycle of the oven appliance; and reducing a power output of the convection heating element over a period of time during the second phase of the preheat cycle.

In a second exemplary embodiment, a method for preheating an oven appliance is provided. The oven appliance includes a cabinet that defines a cooking chamber for receipt of food items for cooking. The cooking chamber extends between a top portion and bottom portion. The oven appliance also includes a bake heating element positioned adjacent the bottom portion of the cooking chamber and a broil heating element positioned adjacent the top portion of the cooking chamber. The oven appliance further includes a convection heating assembly having a fan. The convection heating assembly is configured for selectively urging a flow of heated air into the cooking chamber. The method comprises the steps of: initiating a preheat cycle of the oven appliance, the cooking chamber changing from a first temperature to a second temperature during the preheat cycle, the second temperature being greater than the first temperature, the preheat cycle having a first phase and a second phase; operating at least one of the broil heating element and the bake heating element for the first phase of the preheat cycle of the oven appliance; running the fan of the convection heating assembly during the second phase of the preheat cycle of the oven appliance; and decreasing an angular velocity of the fan over a period of time during the second phase of the preheat cycle.

In a third exemplary embodiment, an oven appliance is provided. The oven appliance comprises a cabinet that defines a cooking chamber for receipt of food items for cooking. The cooking chamber extends between a top portion and bottom portion. A bake heating element is positioned adjacent the bottom portion of the cooking chamber. A broil heating element is positioned adjacent the top portion of the cooking chamber. A convection heating assembly has a fan. The convection heating assembly is configured for selectively urging a flow of heated air into the cooking chamber of said cabinet. A controller is in communication with the bake heating element, the broil heating element, and the convection heating assembly. The controller is configured for: initiating a preheat cycle of the oven appliance, the cooking chamber changing from a first temperature to a second temperature during the preheat cycle, the second temperature being greater than the first temperature, the preheat cycle having a first phase and a second phase; operating at least one of the broil heating element and the bake heating element for the first phase of the preheat cycle of the oven appliance; running the fan of the convection heating assembly during the second phase of the preheat cycle of the oven appliance; and reducing at least one of an angular velocity of the fan, a power output of the broil heating element, and a power output of the bake heating element over a period of time during the second phase of the preheat cycle.

In a fourth exemplary embodiment, a method for preheating an oven appliance is provided. The oven appliance includes a cabinet that defines a cooking chamber for receipt of food items for cooking. The cooking chamber extends between a top portion and bottom portion. The oven appliance also includes a bake heating element positioned adjacent the bottom portion of the cooking chamber and a broil heating element positioned adjacent the top portion of the cooking chamber. The oven appliance further includes a convection heating assembly having a fan and a convection heating element. The convection heating assembly is configured for selectively urging a flow of heated air into the cooking chamber. The method comprises the steps of: initiating a preheat cycle of the oven appliance, the cooking chamber changing from a first temperature to a second temperature during the preheat cycle, the second temperature being greater than the first temperature, the preheat cycle having a first phase and a second phase; operating at least one of the convection heating element, the broil heating element, and the bake heating element for the first phase of the preheat cycle of the oven appliance; running the fan of the convection heating assembly during the second phase of the preheat cycle of the oven appliance; and decreasing an angular velocity of the fan over a period of time during the second phase of the preheat cycle.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIGS. 6 and 8 also illustrate exemplary plots of power to food items within the cooking chamber versus time.

FIGS. 7 and 9 also illustrate exemplary plots of angular velocity versus time for a fan positioned within the cooking chamber. In FIGS. 7 and 9, oven appliance 100 is operated in order to maintain a substantially constant delivery of total power for cooking of food items within the cooking chamber during a second phase of the preheat cycle.

DETAILED DESCRIPTION

Figure 1:
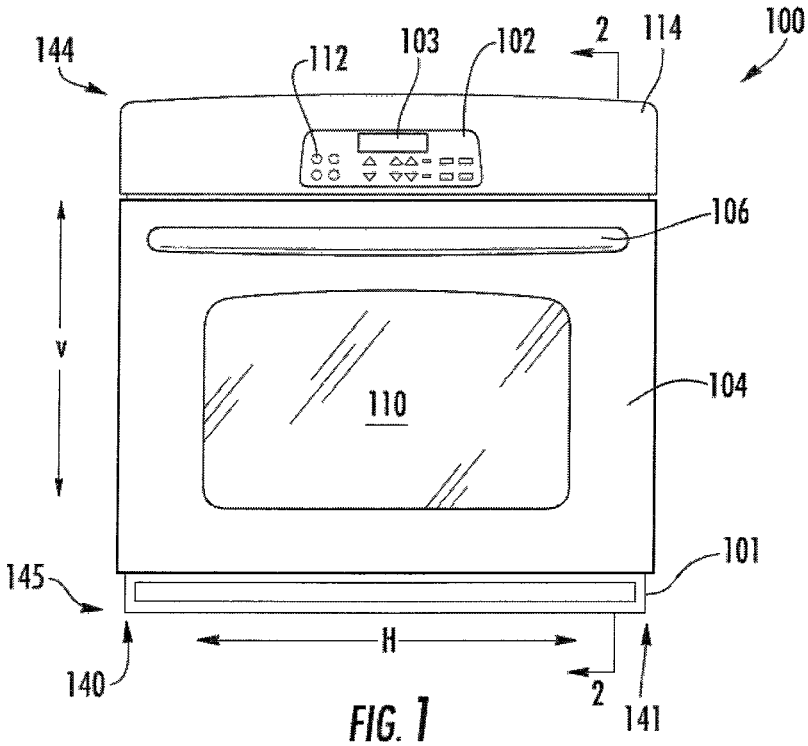
FIG. 1 provides a front view of an oven appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
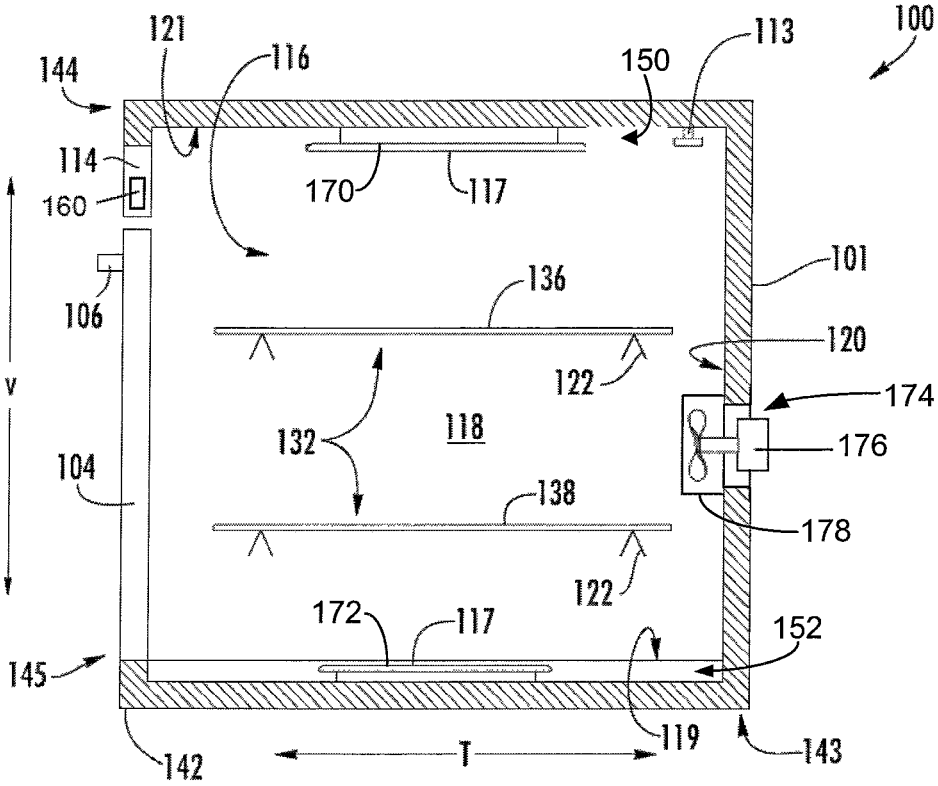
FIG. 2 provides a cross-sectional view of the oven appliance taken along the 2-2 axis of FIG. 1.

Referring to FIGS. 1 and 2, an exemplary embodiment of an oven appliance 100 is shown. FIG. 1 provides a front view of oven appliance 100. FIG. 2 provides a cross-sectional view of oven appliance 100 taken along the 2-2 axis shown in FIG. 1. Oven appliance 100 is shown as a wall oven in FIGS. 1 and 2. However, it should be understood that as used herein the term "oven appliance" is not intended to be limited the oven appliance 100 shown in FIGS. 1 and 2. For example, the present subject matter may also be used with other oven appliances as well such as, e.g., stand-alone oven appliances, oven appliances with stove-tops, and/or other oven appliance configurations.

As shown in FIGS. 1 and 2, oven appliance 100 includes a cabinet or housing 101 that defines a cooking chamber 116 (FIG. 2) therein. Cooking chamber 116 extends between a top portion 150 (FIG. 2) and a bottom portion 152 (FIG. 2). Oven appliance 100 also includes a door 104 with a handle 106 that provides for opening and closing access to a cooking chamber 116. A window 110 on door 104 allows the user to view food items during a cooking cycle of oven appliance 100.

Cabinet 101 extends between a first side 140 (FIG. 1) and a second side 141 (FIG. 1) along a horizontal direction H. Cabinet 101 also extends between a front 142 (FIG. 2) and a back 143 (FIG. 2) along a transverse direction T. Cabinet 101 further extends between a top 144 and a bottom 145 along a vertical direction V. Vertical direction V, horizontal direction H, and transverse direction T are mutually perpendicular and form an orthogonal directional system.

Chamber 101 has interior walls including opposing sidewalls 118, bottom wall 119, back wall 120, and top wall 121 that define cooking chamber 116. Bottom wall 119 and top wall 121 are spaced apart along the vertical direction V, and sidewalls 118 extend along the vertical direction V between top wall 121 and bottom wall 119. Back wall 120 extends between sidewalls 118 along the horizontal direction and also extends between top wall 121 and bottom wall 119 along the vertical direction V.

Sidewalls 118 include supports 122 (FIG. 2) for supporting oven racks 132 (FIG. 2) that may be selectively positioned within cooking chamber 116. A user of oven appliance 100 can place a variety of different food items to be cooked onto racks 132 within cooking chamber 116. Oven racks 132 include a top rack 136 and a bottom rack 137. Top rack 136 is positioned above bottom rack 137 along the vertical direction V. It should be understood that, in alternative exemplary embodiments, oven appliance 100 may include only a single rack or any suitable number of additional racks. Also, as discussed above, oven racks 132 are removable such that a user can remove all but one oven rack 132 or add any suitable number of additional oven racks 132 to cooking chamber 116.

Heating elements 117 are positioned at the top and the bottom of cooking chamber 116 to provide heat for cooking and cleaning. Heating elements 117 may be, e.g., gas, electric, or microwave heating elements or any suitable combination thereof. Other heating elements (not shown) may be located at other locations within or adjacent cooking chamber 116 as well. In the exemplary embodiment shown in FIG. 2, heating elements 117 include a broil heating element 170 positioned adjacent top portion 150 of cooking chamber 116 and a bake heating element 172 positioned adjacent bottom portion 152 of cooking chamber 116.

Oven appliance 100 also includes a convection heating assembly 174. Convection heating assembly 174 has a fan 176 and a convection heating element 178. Convection heating assembly 174 is configured for selectively urging a flow of heated air into cooking chamber 116. For example, fan 176 can pull air from cooking chamber 116 into convection heating assembly 174 and convection heating element 178 can heat such air. Subsequently, fan 176 can urge such heated air back into cooking chamber 116. As another example, fan 176 can cycle heated air from cooking chamber 116 within cooking chamber 116 in order to generate forced convective air currents without use of convection heating element 178. Like heating elements 117 discussed above, convection heating element 178 may be, e.g., a gas, electric, or microwave heating element or any suitable combination thereof. However, in alternative exemplary embodiments, convection heating assembly 174 need not include convection heating element 178.

Referring to FIG. 1, oven appliance 100 includes a user interface 102 having a display 103 positioned on top panel 114 with a variety of controls 112. User interface 102 allows the user to select various options for the operation of oven appliance 100 including e.g., temperature, time, and/or various cooking and cleaning cycles. Although shown with touch type controls 112, it should be understood that controls 112 and the configuration of oven appliance 100 shown in FIG. 1 is provided by way of example only. More specifically, user interface 102 may include various input components, such as one or more of a variety of electrical, mechanical or electromechanical input devices including rotary dials, push buttons, and touch pads. The user interface 102 may include other display components, such as a digital or analog display device designed to provide operational feedback to a user.

Figure 3:
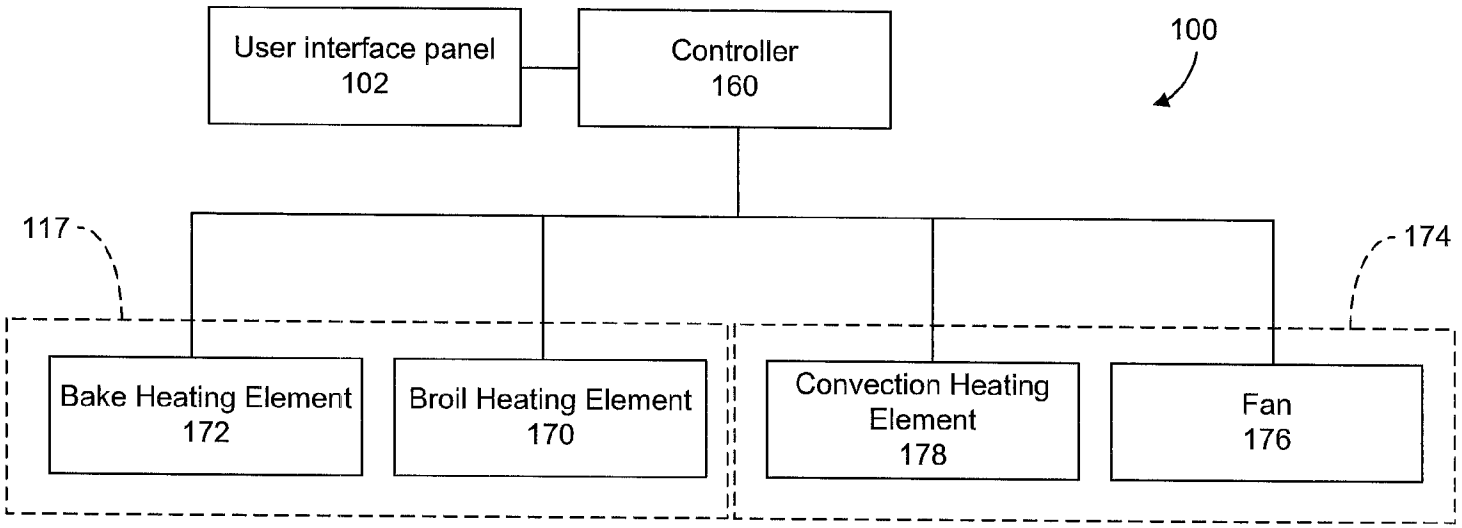
FIG. 3 provides a schematic view of the oven appliance of FIG. 1.

FIG. 3 provides a schematic view of oven appliance 100. A controller 160 is operatively coupled to or in communication with user interface panel 102, heating elements 117, and other components of oven appliance 100. Operation of oven appliance 100 is regulated by controller 160 as will be discussed in greater detail below.

As an example, in response to user manipulation of the user interface panel 102, controller 160 may operate heating elements 117. Controller 160 can also receive temperature measurements from a temperature sensor 113 (FIG. 2) placed within cooking chamber 116 and e.g., provide a temperature indication to the user with display 103 (FIG. 1). By way of example, controller 160 may include a memory and one or more processing devices such as microprocessors, CPUs or the like, such as general or special purpose microprocessors operable to execute programming instructions or micro-control code associated with operation of oven appliance 100. The memory may represent random access memory such as DRAM, or read only memory such as ROM or FLASH. In one exemplary embodiment, the processor executes programming instructions stored in memory. The memory may be a separate component from the processor or may be included onboard within the processor.

Controller 160 may be positioned in a variety of locations throughout oven appliance 100. Thus, controller 160 may be located under or next to the user interface 102 or otherwise within top panel 114. In an exemplary embodiment, input/output ("I/O") signals are routed between controller 160 and various operational components of oven appliance 100 such as heating elements 117, controls 112, display 103, sensor(s), alarms, and/or other components of oven appliance 100 as may be provided. In one exemplary embodiment, the user interface panel 102 may represent a general purpose I/O ("GPIO") device or functional block. User interface 102 may be in communication with controller 160 via one or more signal lines or shared communication busses.

As shown in FIG. 3, controller 160 is operatively coupled to or in communication with bake heating element 172, broil heating element 170, and convection heating assembly 174 including fan 176 and convection heating element 178. As an example, in response to user manipulation of the user interface panel 102, controller 160 can operate bake heating element 172, broil heating element 170, fan 176 and/or convection heating element 178. In particular, controller 160 can activate bake heating element 172, broil heating element 170, fan 176 and/or convection heating element 178 during a preheat cycle of oven appliance 100 as discussed in greater detail below.

Figure 4:
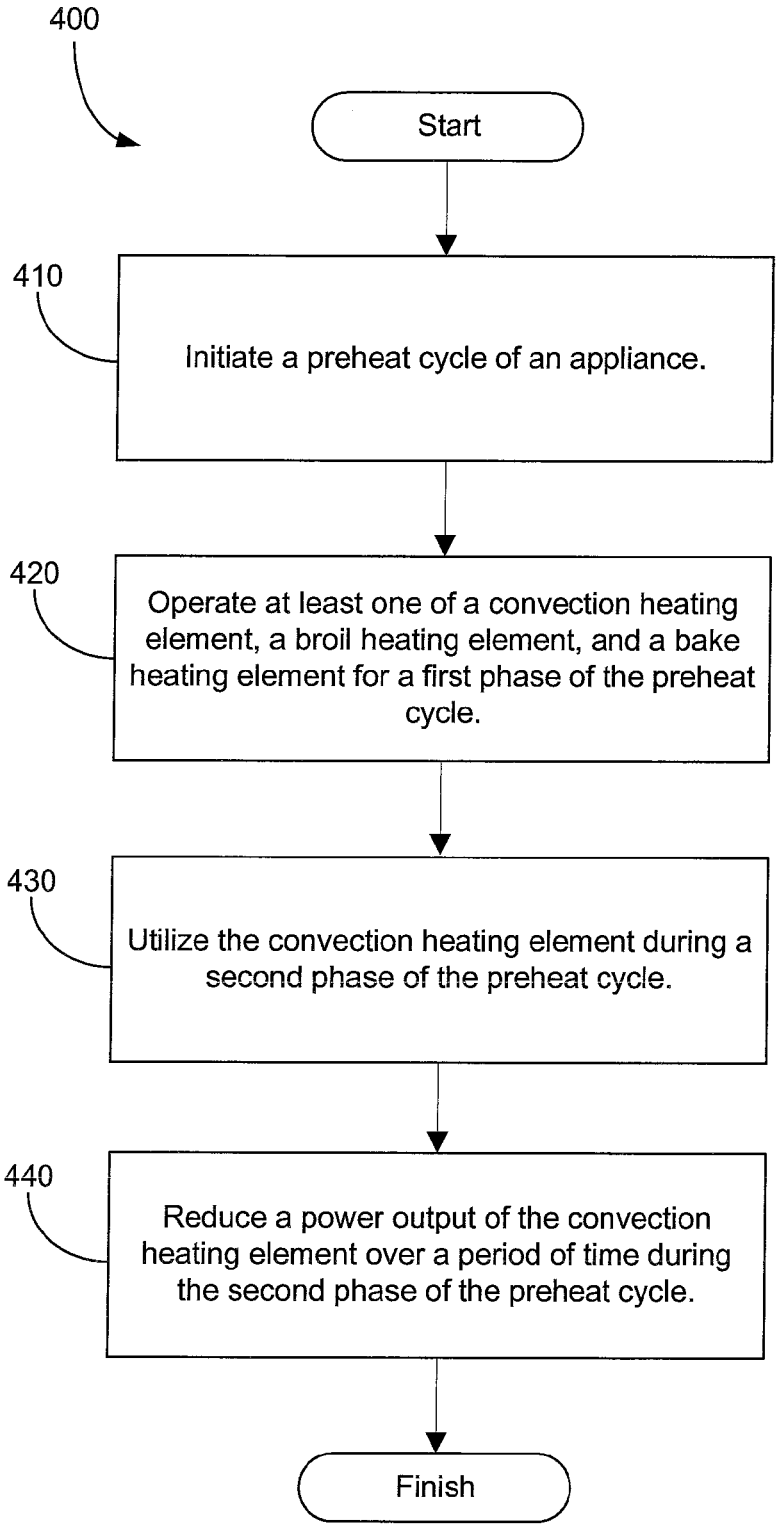
FIGS. 4 and 5 illustrate methods for operating an oven appliance, such as the oven appliance of FIG. 1, according to exemplary embodiments of the present subject matter.
Figure 5:
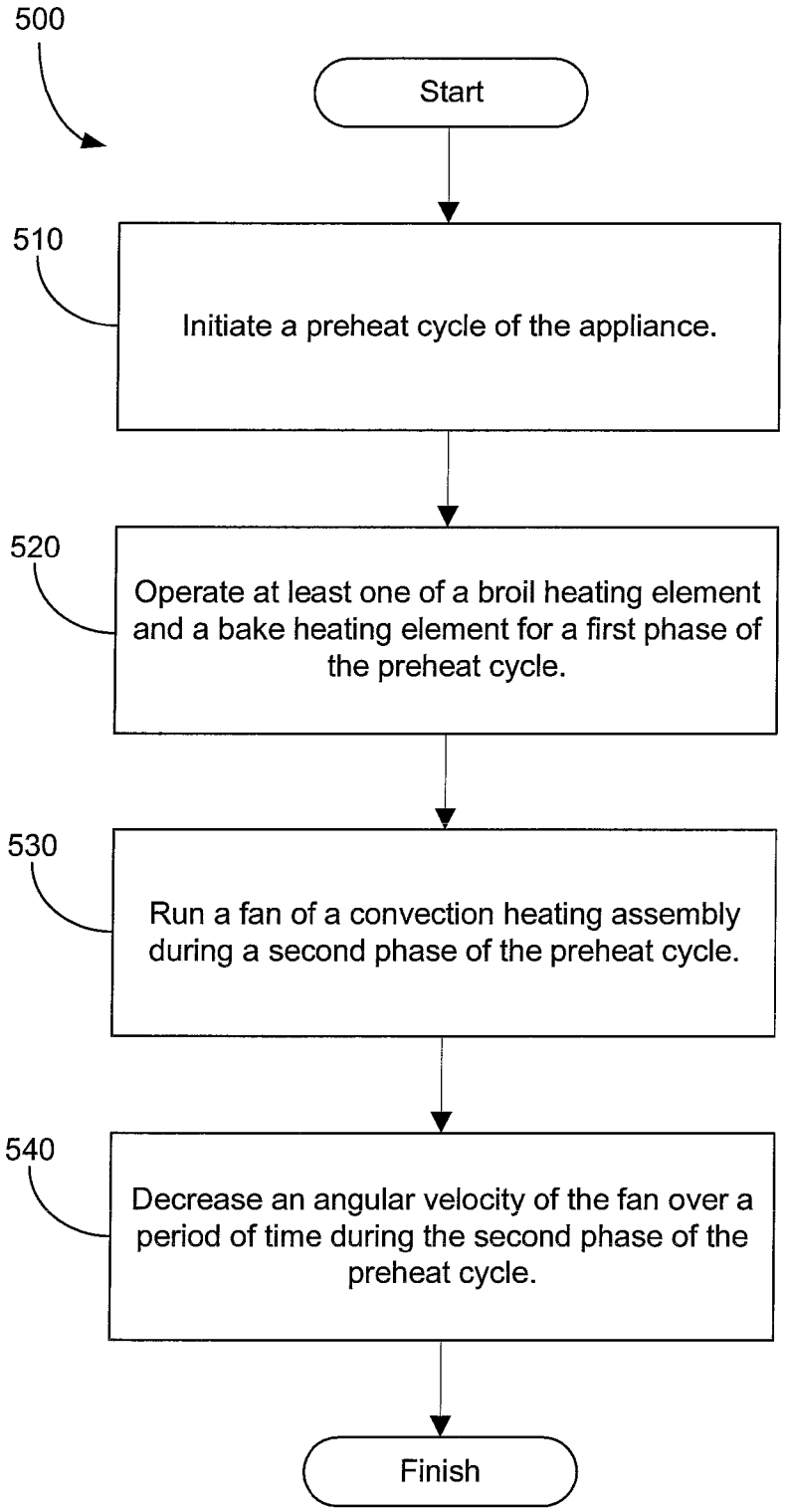

FIGS. 4 and 5 illustrate methods 400 and 500 for operating an appliance, such as oven appliance 100, according to exemplary embodiments of the present subject matter. It should be understood that methods 400 and 500 may be used in other oven appliance as well such as range appliances. Controller 160 may be programmed to perform methods 400 and 500.

Methods 400 and 500 are methods for preheating an appliance, e.g., oven appliance 100. In particular, methods 400 and 500 facilitate cooking of food items within cooking chamber 116 during the preheat cycle of oven appliance 100. During the preheat cycle of oven appliance 100, a temperature within cooking chamber 116 is raised from a first temperature, e.g., an ambient temperature of about seventy degrees Fahrenheit, to a second temperature, e.g., a steady-state operating temperature of about three hundred and fifty degrees Fahrenheit. Methods 400 and 500 can permit the food items to cook properly despite the oven appliance 100 not having reached the steady-state operating temperature.

Turning to FIG. 4, method 400 is illustrated. At step 410, controller 160 initiates the preheat cycle of oven appliance 100. During the preheat cycle, cooking chamber 116 changes from a first, lower temperature to a second, higher temperature as the cooking chamber 116 is heated to the steady-state operating temperature. The preheat cycle has a phase one or first phase and a phase two or second phase.

At step 420, controller 160 operates at least one of convection heating element 178, broil heating element 170, and bake heating element 172 for the phase one of the preheat cycle. At step 420, controller 160 can hold or maintain power outputs of broil heating element 170, bake heating element 172, and convection heating element 178 substantially constant during phase one of the preheat cycle. For example, controller 160 can operate broil heating element 170, bake heating element 172, or convection heating element 178 at a single duty cycle during phase one of the preheat cycle in order to maintain power outputs of such elements substantially constant. In alternative exemplary embodiments, controller 160 can also operate fan 176 of convection heating assembly 174 at step 420.

At step 430, controller 160 utilizes at least convection heating element 174 during phase two of the preheat cycle. In alternative exemplary embodiments, controller 160 can also utilize fan 176 of convection heating assembly 174 at step 430.

At step 440, controller 160 reduces the power output of convection heating element 178 over a period of time during phase two of the preheat cycle, e.g., to about a steady-state power output of convection heating element 178. By reducing the power output of convection heating element 178, a total power input to food items within cooking chamber 116 of oven appliance 100 may be substantially constant during phase two of the preheat cycle. As an example, the total power input to food items within the cooking chamber 116 at any time during phase two of the preheat cycle may not deviate from the average total power input to food items within the cooking chamber 116 during phase two by more than about five percent, ten percent, fifteen percent, twenty percent, or any other suitable percentage or value. The total power input to food items can include, e.g., the power output of broil heating element 170, the power output of bake heating element 172, the power output of convection heating assembly 174, and/or any other heat transfer mechanism that applies power to cooking chamber 116 during operation of oven appliance 100 as will be understood by those skilled in the art.

The substantially constant total power input to food items within cooking chamber 116 during the second portion of the preheat cycle can permit a user to place food items within cooking chamber 116 during the preheat cycle of oven appliance 100, e.g., during the second portion of preheat cycle. In particular, the power transfer to food items within the cooking chamber 116 during the second portion of the preheat cycle can be matched to the power transfer to food items within the cooking chamber 116 when the cooking chamber 116 is at the steady-state operating temperature as discussed in greater detail below.

Turning to FIG. 5, method 500 is illustrated. Method 500 is similar to method 400 (FIG. 4). At step 510, controller 160 initiates a preheat cycle of oven appliance 100. Like in method 400, cooking chamber 116 changes from a first, lower temperature to a second, higher temperature as the cooking chamber 116 is heated to the steady-state operating temperature during the preheat cycle of step 510. Also, the preheat cycle has a phase one or first phase and a phase two or second phase.

At step 520, controller 160 operates at least one of broil heating element 170 and bake heating element 172 for phase one of the preheat cycle of oven appliance 100. At step 520, power outputs of broil heating element 170 and bake heating element 172 are substantially constant during phase one of the preheat cycle. In alternative exemplary embodiments, controller 160 can also operate fan 176 of convection heating assembly 174 at step 520.

At step 530, controller 160 runs fan 176 of convection heating assembly 174 during phase two of the preheat cycle of oven appliance 100. In alternative exemplary embodiments, controller 160 can also utilize convection heating element 178 of convection heating assembly 174 at step 530.

At step 540, controller 160 decreases the angular velocity of fan 176 over a period of time during phase two of the preheat cycle, e.g., to about a steady-state angular velocity selected by a user. By reducing the angular velocity during phase two of the preheat cycle, a total power input to food items within cooking chamber 116 can be substantially constant during phase two of the preheat cycle. Like in method 400 described above, such substantially constant total power input can permit a user to place food items within cooking chamber 116 during the preheat cycle of oven appliance 100, e.g., during the second portion of preheat cycle. In particular, the power transfer to food items within the cooking chamber 116 during the second portion of the preheat cycle can be matched to the power transfer to food items within the cooking chamber 116 when the cooking chamber 116 is at the steady-state operating temperature as discussed in greater detail below.

Controller 160 can implement methods 400 and 500 in order to permit a user to insert and properly cook food items within the cooking chamber 116 of oven appliance 100 during the second portion of the preheat cycle. In method 400, the power output of convection heating element 178 is reduced during the second portion of the preheat cycle in order to maintain a substantially constant total power input to food items in cooking chamber 116 of oven appliance 100 during phase two of the preheat cycle. Conversely, the angular velocity of fan 176 is decreased during the second portion of the preheat cycle in order to maintain a substantially constant total power input to food items in cooking chamber 116 of oven appliance 100 during phase two of the preheat cycle in method 500. However, it should be understood that in alternative exemplary embodiments, both the power output of convection heating element 178 and the angular velocity of fan 176 can be reduced, e.g., simultaneously, in order to maintain a substantially constant total power input to food items in cooking chamber 116 of oven appliance 100 during phase two of the preheat cycle. Additional exemplary methods for preheating oven appliance 100 are discussed below.

Figure 6:
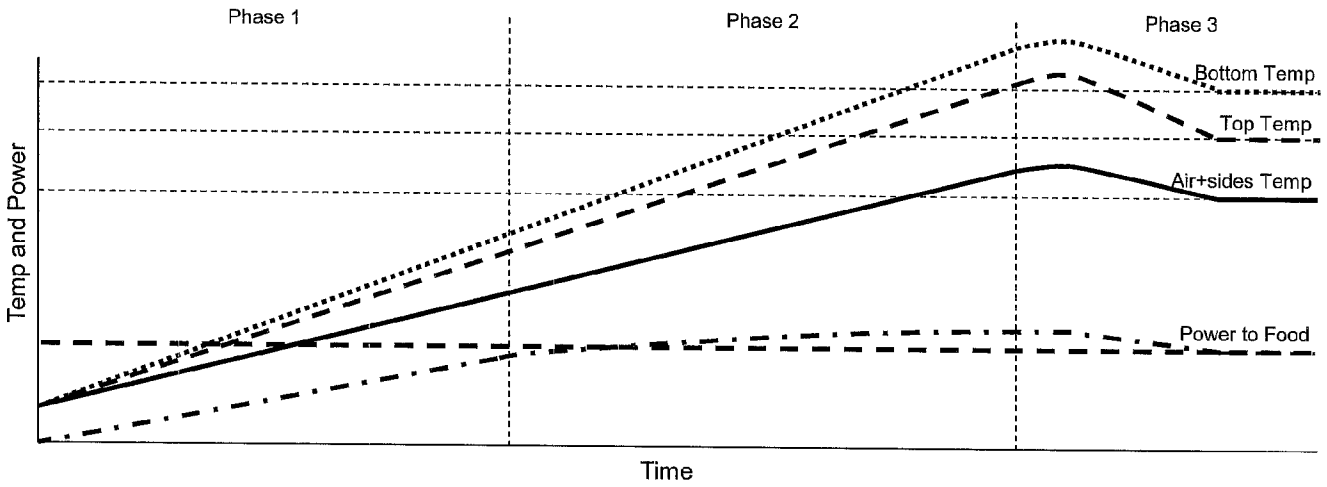
FIGS. 6 and 8 illustrate exemplary plots of temperature versus time for various locations within a cooking chamber of the oven appliance of FIG. 1 during a preheat cycle of the oven appliance.
Figure 7:
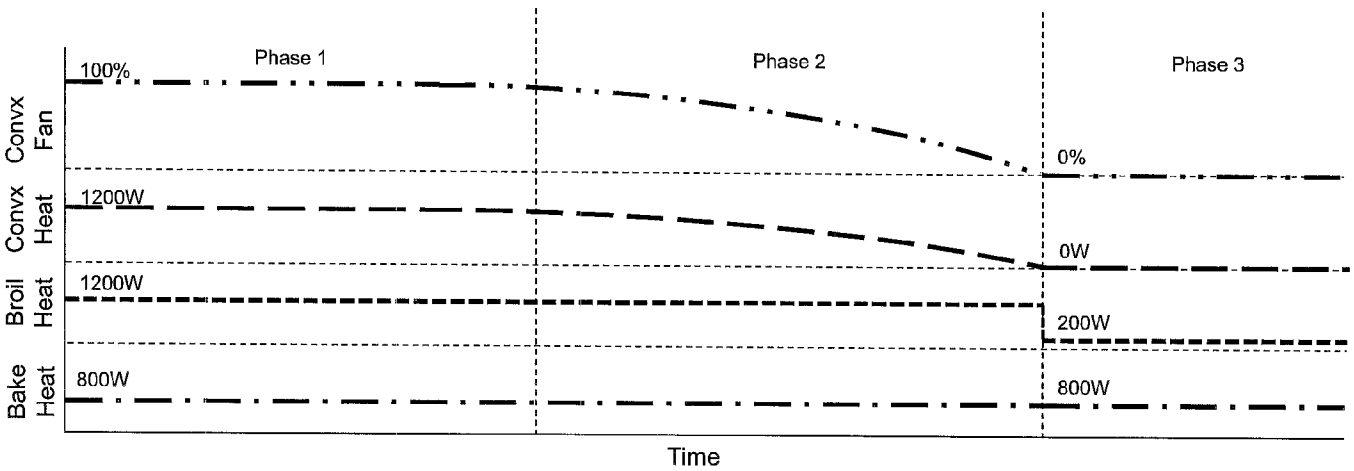
FIGS. 7 and 9 illustrate exemplary plots of output power versus time for various heating elements within the cooking chamber during a preheat cycle of the oven appliance of FIG. 1.
Figure 8:
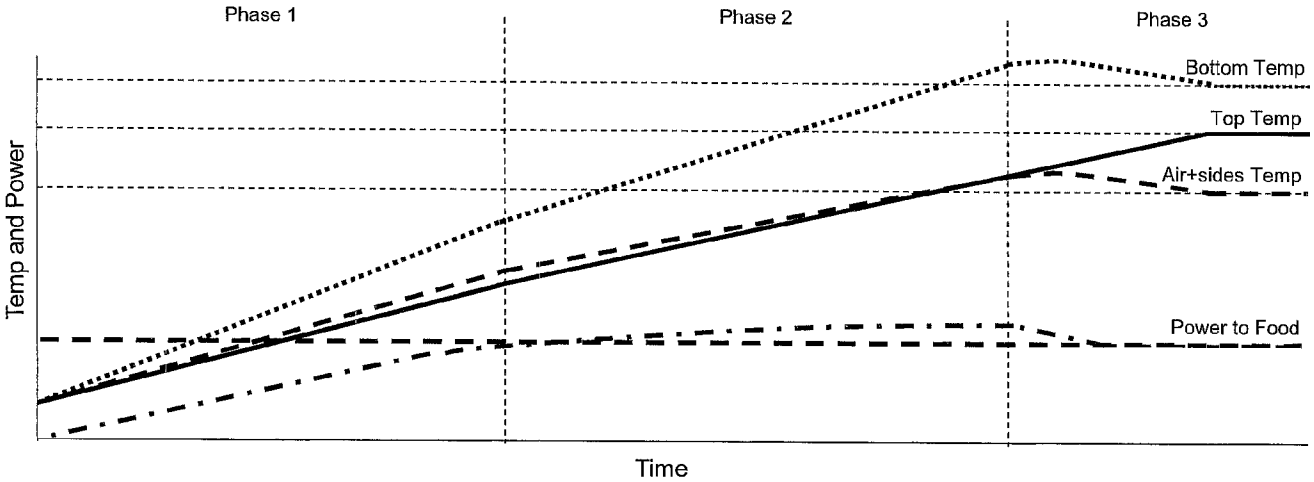
Figure 9:
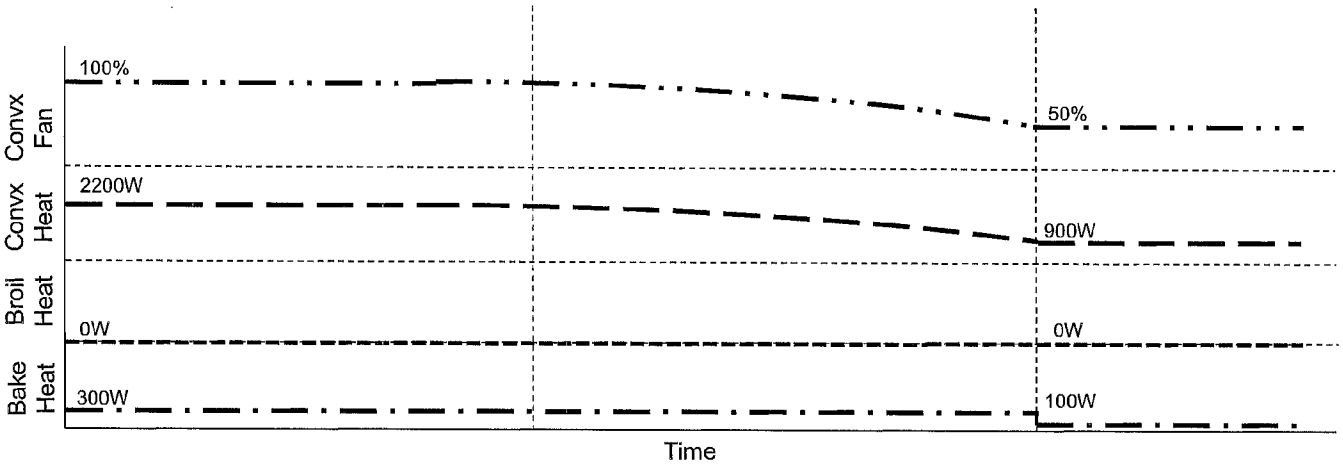

FIGS. 6 and 8 illustrate exemplary plots of temperature versus time for various locations within cooking chamber 116 of oven appliance 100 during the preheat cycle of oven appliance 100. FIGS. 6 and 8 also illustrate exemplary plots of power to food items within cooking chamber 116 versus time during the preheat cycle. FIGS. 7 and 9 illustrate exemplary plots of output power versus time for various heating elements within cooking chamber 116 during the preheat cycle of oven appliance 100. FIGS. 7 and 9 also illustrate exemplary plots of angular velocity versus time for fan 176 of convection heating assembly 174. In FIGS. 7 and 9, controller 160 operates oven appliance 100 such that the total input of power to food items in cooking chamber 116 is substantially constant during the second portion of the preheat cycle.

FIGS. 6 and 7 correspond to an exemplary embodiment of a method for operating oven appliance 100. In particular, the method shown in FIGS. 6 and 7 can be utilized to cook a single rack of food items in cooking chamber 116. FIGS. 8 and 9 correspond to an additional exemplary embodiment of a method for operating oven appliance 100. In particular, the method shown in FIGS. 8 and 9 can be utilized to cook multiple racks of food items in cooking chamber 116. The method shown in FIGS. 6 and 7 can be more suitable to cook a single rack of food items because broil heating element 170 and bake heating element 172 can evenly heat food items on the single rack without obstruction. Conversely, the method shown in FIGS. 8 and 9 utilizes convection heating assembly 174 to evenly heat multiple racks of food items.

In the exemplary embodiment shown in FIG. 7, controller 160 operates convection heating element 178, broil heating element 170, and bake heating element 172 during phase one of the preheat cycle of oven appliance 100. In particular, a power output of convection heating element 178 is about twelve hundred watts during phase one, a power output of broil heating element 170 is also about twelve hundred watts during phase one, and a power output of bake heating element 172 is about eight hundred watts during phase one. As an example, controller 160 can operate convection heating element 178, broil heating element 170, and bake heating element 172 such that they operate with particular power outputs by selecting a particular duty cycle for each element, by utilizing a TRIAC control, or with any other suitable method or mechanism as will be understood by those skilled in the art.

Controller 160 also operates fan 176 during phase one of the preheat cycle of oven appliance 100. In particular, an angular velocity of fan 176 is about one hundred percent of a maximum angular velocity of fan 176 during phase one. As may be seen in FIG. 6, when controller 160 operates convection heating element 178, broil heating element 170, bake heating element 172, and fan 176 in the manner described above, the temperature of cooking chamber 116 increases and the power to food items within cooking chamber 116 increases as well. As an example, TRIAC control and/or duty cycle adjustment may also be utilized to control the angular velocity of fan 176.

Conversely, during phase two of the preheat cycle of oven appliance 100, controller 160 decreases the power output of convection heating element 178 and the angular velocity of fan 176 over a period of time. In particular, the power output of convection heating element 178 drops from about twelve hundred watts to about zero watts over the period of time during phase two, and the angular velocity of fan 176 drops from about one hundred percent of the maximum angular velocity of fan 176 to about zero percent of the maximum angular velocity of fan 176, i.e., about zero radians per second, over the period of time during phase two. As an example, controller 160 can decrease the power output of convection heating element 178 by reducing the duty cycle of convection heating element 178, by utilizing the TRIAC control, or with any other suitable method or mechanism as will be understood by those skilled in the art. Similar methods, e.g., TRIAC control and/or duty cycle adjustment may be utilized to control an angular velocity of fan 176.

During phase two, controller 160 also maintains the same power outputs for broil heating element 170 and bake heating element 172 as during phase one of the preheat cycle. As may be seen in FIG. 6, when controller 160 reduces the power output of convection heating element 178 and the angular velocity of fan 176, the temperature of cooking chamber 116 continues to increase. However, the power to food items within cooking chamber 116 levels off and becomes substantially constant due to reduced convection heat transfer.

In FIGS. 6 and 7, phase three corresponds to the steady-state operating conditions for oven appliance 100, i.e., the preheat cycle of oven appliance 100 terminates when phase three begins. As may be seen in FIG. 7, controller 160 operates broil heating element 170 and bake heating element 172 and deactivates convection heating element 178 and fan 176 during phase three. In particular, the power output of broil heating element 170 is about two hundred watts during phase three, and the power output of bake heating element 172 remains at about eight hundred watts during phase three. As may be seen in FIG. 6, when controller 160 operates broil heating element 170 and bake heating element 172 in such a manner, the power to food items within cooking chamber 116 is substantially constant.

In FIG. 6, the power to food items within cooking chamber 116 is substantially constant or equal in both phase two and phase three. Thus, food items placed within cooking chamber 116 during phase two will cook at about the same rate and in the same manner as food items that remain within the cooking chamber 116 during phase three or are placed within cooking chamber 116 during phase three. Thus, by reducing the power output of convection heating element 178 and the angular velocity of fan 176 over a period of time during phase two, food items can be cooked within cooking chamber 116 during the preheat cycle of oven appliance 100 and such food items may cook in the same manner or at the same rate as the steady-state oven conditions of phase three.

The method shown in FIGS. 8 and 9 is similar to the method shown in FIGS. 6 and 7. However, as discussed above, the method shown in FIGS. 8 and 9 can be more suitable for cooking with multiple oven racks because convection heating assembly 174 can evenly heat multiple racks of food items.

In FIG. 9, controller 160 operates convection heating element 178 and bake heating element 172 during phase one of the preheat cycle of oven appliance 100. In particular, a power output of convection heating element 178 is about twenty-two hundred watts during phase one and a power output of bake heating element 172 is about three hundred watts during phase one. As an example, controller 160 can operate convection heating element 178, broil heating element 170, and bake heating element 172 such that they operate with particular power outputs by selecting a particular duty cycle for each element, by utilizing the TRIAC control, or with any other suitable method or mechanism as will be understood by those skilled in the art. Controller 160 also operates fan 176 during phase one of the preheat cycle of oven appliance 100 at about one hundred percent of a maximum angular velocity of fan 176. As an example, TRIAC control and/or duty cycle adjustment may also be utilized to control the angular velocity of fan 176.

Conversely, during the phase two of the preheat cycle of oven appliance 100, controller 160 decreases the power output of convection heating element 178 and the angular velocity of fan 176. In particular, the power output of convection heating element 178 drops from about twenty-two hundred watts to about nine hundred watts during phase two, and the angular velocity of fan 176 drops from about one hundred percent of the maximum angular velocity of fan 176 to about fifty percent of the maximum angular velocity of fan 176 during phase two. During phase two, controller 160 also maintains the same power outputs for bake heating element 172 as during phase one of the preheat cycle.

In addition, controller 160 operates bake heating element 172, convection heating element 178 and fan 176 during phase three. In particular, the power output of bake heating element 172 is about one hundred watts during phase three, and the power output of convection heating element 178 remains at about eight hundred watts during phase three. As may be seen in FIG. 8, when controller 160 operates convection heating element 178, fan 176, and bake heating element 172 in such a manner, the power to food items within cooking chamber 116 is substantially constant. Thus, in the same manner as the method shown in FIGS. 6 and 7, food items placed within cooking chamber 116 during phase two will cook at about the same rate and in the same manner as food items within the cooking chamber 116 during phase three.

For the methods shown in FIGS. 6-9, phase one of the preheat cycle ends when the temperatures within oven appliance 100 reach values that yield similar heating of food items within cooking chamber 116 as the steady-state operating condition selected by the user when combined with convection airflow from convection heating assembly 174. However, it should be understood that the preheat cycle transition between phase one and phase two is governed by the steady-state condition or the mode selected by a user. For example, a 475° F. steady-state bake may transition between the phase one and two of the preheat cycle later than a 350° F. steady-state bake due to the greater amount of time needed to heat up oven appliance 100. Similarly, a multi-rack convection bake of 350° F. uses convection heating assembly 174 during steady-state operation, but convection heating assembly 174 can operate at a lower effective speed in the steady-state relative to the preheat cycle. However, the 350° F. convection bake may transition between phase one and two of the preheat cycle later than a 350° F. non-convection bake due to the greater heat transfer requirements of the convection bake mode.

In additional exemplary embodiments, the power outputs of broil heating element 170 and/or bake heating element 172 may be increased or decreased over a period of time during phase two of the preheat cycle in order to maintain a substantially constant power to food items within cooking chamber 116.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for preheating an oven appliance, the oven appliance including a cabinet that defines a cooking chamber for receipt of food items for cooking, the cooking chamber extending between a top portion and bottom portion, the oven appliance also including a bake heating element positioned adjacent the bottom portion of the cooking chamber, the oven appliance further including a broil heating element positioned adjacent the top portion of the cooking chamber, the oven appliance also including a convection heating assembly having a fan and a convection heating element, the convection heating assembly configured for selectively urging a flow of heated air into the cooking chamber, the method comprising:

initiating a preheat cycle of the oven appliance, the cooking chamber changing from a first temperature to a second temperature during the preheat cycle, the second temperature being greater than the first temperature, the preheat cycle having a first phase and a second phase;

operating at least one of the convection heating element, the broil heating element, and the bake heating element for the first phase of the preheat cycle of the oven appliance;

utilizing the convection heating element during the second phase of the preheat cycle of the oven appliance; and reducing a power output of the convection heating element over a period of time to about a steady-state power output during the second phase of the preheat cycle.

2. The method of claim 1, wherein the power output of the convection heating element is reduced during said step of reducing by adjusting a duty cycle of the convection heating element.

3. The method of claim 1, wherein the convection heating element includes a TRIAC control for adjusting the power output of the convection heating element, wherein the power output of the convection heating element is reduced during said step of reducing with the TRIAC control.

4. The method of claim 1, further comprising:

running the fan of the convection heating assembly during the second phase of a preheat cycle of the oven appliance.

5. The method of claim 4, further comprising decreasing an angular velocity of the fan over the period of time during the second phase of the preheat cycle.

6. The method of claim 1, wherein the power output of the convection heating element is reduced in order to maintain a substantially constant power input to food items within the cooking chamber during said step of reducing.

7. The method of claim 1, further comprising increasing or decreasing the Power output of at least one of the bake heating element and the broil heating element over the period of time during the second phase of the preheat cycle.

8. A method for preheating an oven appliance, the oven appliance including a cabinet that defines a cooking chamber for receipt of food items for cooking, the cooking chamber extending between a top portion and bottom portion, the oven appliance also including a bake heating element positioned adjacent the bottom portion of the cooking chamber, the oven appliance further including a broil heating element positioned adjacent the top portion of the cooking chamber, the oven appliance also including a convection heating assembly having a fan, the convection heating assembly configured for selectively urging a flow of heated air into the cooking chamber, the method comprising:

initiating a preheat cycle of the oven appliance, the cooking chamber changing from a first temperature to a second temperature during the preheat cycle, the second temperature being greater than the first temperature, the preheat cycle having a first phase and a second phase;

operating at least one of the broil heating element and the bake heating element for the first phase of the preheat cycle of the oven appliance;

running the fan of the convection heating assembly during the second phase of the preheat cycle of the oven appliance; and decreasing an angular velocity of the fan over a period of time during the second phase of the preheat cycle.

9. The method of claim 8, wherein the convection heating assembly further includes a convection heating element, the method further comprising activating the convection heating element for the second phase of the preheat cycle of the oven appliance.

10. The method of claim 9, further comprising reducing a power output of the convection heating element over a period of time during the second phase of the preheat cycle.

11. The method of claim 10, wherein the power output of the convection heating element is reduced over the period of time to about a steady-state power output during said step of reducing.

12. The method of claim 8, wherein the angular velocity of the fan is reduced over the period of time to about a steady-state angular velocity during said step of decreasing.

13. The method of claim 8, wherein the angular velocity of the fan is reduced during said step of decreasing by adjusting a duty cycle of the fan.

14. The method of claim 8, wherein the fan includes a TRIAC control for adjusting the angular velocity of the fan, wherein the angular velocity of the fan is reduced during said step of decreasing with the TRIAC control.

15. The method of claim 8, wherein the angular velocity of the fan is reduced in order to maintain a substantially constant power input to food items within the cooking chamber during said step of decreasing.

16. The method of claim 8, further comprising increasing or decreasing the power output of at least one of the bake heating element and the broil heating element over the period of time during the second phase of the preheat cycle.

17. An oven appliance comprising:

a cabinet that defines a cooking chamber for receipt of food items for cooking, the cooking chamber extending between a top portion and bottom portion;

a temperature sensor configured for measuring a temperature of the cooking chamber;

a bake heating element positioned adjacent the bottom portion of the cooking chamber;

a broil heating element positioned adjacent the top portion of the cooking chamber;

a convection heating assembly having a fan, the convection heating assembly configured for selectively urging a flow of heated air into the cooking chamber; and a controller in communication with said temperature sensor, said bake heating element, said broil heating element, and said convection heating assembly, said controller configured for:

initiating a preheat cycle of the oven appliance, the cooking chamber changing from a first temperature to a second temperature during the preheat cycle, the second temperature being greater than the first temperature, the preheat cycle having a first phase and a second phase;

operating at least one of the broil heating element and the bake heating element for the first phase of the preheat cycle of the oven appliance;

running the fin of the convection heating assembly during the second phase of the preheat cycle of the oven appliance; and reducing an angular velocity of the fan over a period of time via a TRIAC control during the second phase of the preheat cycle.

18. The oven appliance of claim 17, wherein the controller is further configured for increasing or decreasing a power output of at least one of the bake heating element or the broil heating element over the period of time during the second phase of the preheat cycle.

19. A method for preheating an oven appliance, the oven appliance including a cabinet that defines a cooking chamber for receipt of food items for cooking, the cooking chamber extending between a top portion and bottom portion, the oven appliance also including a bake heating element positioned adjacent the bottom portion of the cooking chamber, the oven appliance further including a broil heating element positioned adjacent the top portion of the cooking chamber, the oven appliance also including a convection heating assembly having a fan and a convection heating element, the convection heating assembly configured for selectively urging a flow of heated air into the cooking chamber, the method comprising:

initiating a preheat cycle of the oven appliance, the cooking chamber changing from a first temperature to a second temperature during the preheat cycle, the second temperature being greater than the first temperature, the preheat cycle having a first phase and a second phase;

operating at least one of the convection heating element, the broil heating element, and the bake heating element for the first phase of the preheat cycle of the oven appliance;

running the fan of the convection heating assembly during the second phase of the preheat cycle of the oven appliance; and decreasing an angular velocity of the fan over a period of time during the second phase of the preheat cycle.

* * * * *